US010690429B2

(12) United States Patent
Murphy, II et al.

(10) Patent No.: US 10,690,429 B2
(45) **Date of Patent: *Jun. 23, 2020**

(54) LONG GUN STOCK WITH SLIDING TRIGGER ENCLOSURE

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/446,211

(22) Filed: Jun. 19, 2019

(65) Prior Publication Data

US 2019/0331447 A1 Oct. 31, 2019

Related U.S. Application Data

(63) Continuation of application No. 16/229,007, filed on Dec. 21, 2018, now Pat. No. 10,378,846, which is a (Continued)

(51) Int. Cl.

| | |
|---|---|
| ***F41A 17/46*** | (2006.01) |
| ***F41A 17/06*** | (2006.01) |
| ***F41A 17/48*** | (2006.01) |
| ***F41C 23/22*** | (2006.01) |
| ***F41A 17/54*** | (2006.01) |
| ***F41A 17/22*** | (2006.01) |
| *F41C 23/14* | (2006.01) |

(52) U.S. Cl.

CPC ..... *F41A 17/066* (2013.01); *F41A 17/22* (2013.01); *F41A 17/46* (2013.01); *F41A 17/48* (2013.01); *F41A 17/54* (2013.01); *F41C 23/22* (2013.01); *F41C 23/14* (2013.01)

(58) Field of Classification Search

CPC ..... F41A 17/54; F41A 17/066; F41A 17/06; F41A 17/20; F41A 17/22; F41A 17/46

USPC ..... 42/70.06, 70.07, 85, 96

See application file for complete search history.

(56) References Cited

U.S. PATENT DOCUMENTS

| | | | |
|---|---|---|---|
| 35,456 | A | 6/1862 | Leverich |
| 955,237 | A | 4/1910 | Westcott et al. |

(Continued)

FOREIGN PATENT DOCUMENTS

| | | | |
|---|---|---|---|
| DE | 102006005117 | A1 | 8/2007 |
| EP | 1058081 | B1 | 1/2006 |

*Primary Examiner* — Jonathan C Weber

(74) *Attorney, Agent, or Firm* — Jason T. Daniel, Esq.; Daniel Law Offices, P.A.

(57) ABSTRACT

A sliding trigger enclosure system for a long gun includes a frame that is removably secured to the receiver of a firearm by factory-supplied hardware, and a hollow shoulder stock having a pair of side surfaces that extend outward from the front end. The shoulder stock is slidingly engaged over the frame and transitions between a FIRE position where the trigger assembly of the long gun is accessible, and a SAFE position where the pair of side surfaces are locked in a parallel orientation to the trigger assembly to prevent access to the same. A locking mechanism is disposed along the frame and secures the shoulder stock in the SAFE position. The locking mechanism including a pair of spring-loaded locking pins that are engaged by an actuator, and a user authentication device.

20 Claims, 8 Drawing Sheets

Related U.S. Application Data continuation-in-part of application No. 15/040,966, filed on Feb. 12, 2016, now abandoned, which is a continuation-in-part of application No. 13/732,583, filed on Jan. 2, 2013, now Pat. No. 9,810,500, and a continuation-in-part of application No. 14/885,394, filed on Oct. 16, 2015, now abandoned.

(56) References Cited

U.S. PATENT DOCUMENTS 1,569,553 A 1/1926 Lewis et al.
1,686,482 A 10/1928 Windle
1,695,071 A 12/1928 Mariand
1,887,308 A 11/1932 Leroy
2,080,202 A 5/1937 Drake
2,115,041 A 4/1938 Alejandro
2,525,886 A * 10/1950 Fraser ..... F41A 17/20 42/70.03
2,590,516 A 3/1952 Von
2,932,334 A 4/1960 Steen
3,222,809 A 12/1965 Bryan
3,224,587 A 12/1965 Schmidt
3,324,587 A * 6/1967 Bryan ..... F41A 17/20 42/70.06
3,392,471 A 7/1968 Foote
4,422,254 A 12/1983 McQueen
4,754,498 A 7/1988 Stinemates
4,858,361 A 8/1989 White
4,860,479 A 8/1989 Easter
5,012,605 A 5/1991 Nishioka
5,024,017 A 6/1991 Nishioka
5,075,994 A 12/1991 Nishioka
5,138,786 A 8/1992 Fischer
5,229,532 A 7/1993 Brooks
5,419,068 A 5/1995 Pages et al.
5,638,627 A 6/1997 Klein et al.
5,930,929 A * 8/1999 Bubits ..... F41A 17/46 42/70.06
5,992,075 A 11/1999 Ockenfuss et al.
6,141,896 A 11/2000 Oberst
6,154,995 A 12/2000 Lenoir et al.
6,164,004 A 12/2000 Essary
6,206,261 B1 3/2001 McCrary
6,240,669 B1 6/2001 Spaniel et al.
6,253,480 B1 7/2001 Florez
6,389,726 B1 5/2002 Bentley
6,405,861 B1 6/2002 Slier et al.
6,459,064 B1 10/2002 Trubert
6,578,307 B2 6/2003 Troyer
6,807,763 B1 * 10/2004 Leung ..... F41C 23/06 42/69.01
7,030,729 B2 4/2006 Albanesi et al.
7,146,762 B1 * 12/2006 Leung ..... F41C 23/22 42/86
7,194,836 B1 3/2007 Urban
8,713,836 B1 5/2014 Haq
8,807,007 B2 8/2014 Alicea
8,931,393 B1 1/2015 Vincent et al.
9,097,479 B1 8/2015 Barido et al.
9,404,699 B1 8/2016 Barido et al.
9,459,064 B1 10/2016 Xu
9,658,017 B2 5/2017 Alicea
9,733,033 B1 8/2017 Barido et al.
9,746,266 B1 8/2017 Barido et al.
9,841,250 B1 12/2017 Mirza
2002/0116856 A1 8/2002 Troyer
2003/0140542 A1 * 7/2003 Kay ..... F41C 23/16 42/75.03
2010/0154271 A1 6/2010 Victor et al.
2011/0047849 A1 3/2011 Brenner
2012/0137559 A1 6/2012 Burns
2015/0204628 A1 7/2015 Würkner
2016/0084601 A1 3/2016 Alicea

* cited by examiner

LONG GUN STOCK WITH SLIDING TRIGGER ENCLOSURE

TECHNICAL FIELD

The present invention relates generally to firearms, and more particularly to a firearm stock with a sliding trigger enclosure.

BACKGROUND

The statements in this section merely provide background information related to the present disclosure and may not constitute prior art.

As any responsible firearm owner will attest, firearms should always remain locked when they are not in use, so as to prevent an accidental discharge of the same and/or to prevent access by an unauthorized individual. As such, there are many known types of commercially available firearm locking mechanisms such as trigger guards and/or trigger locks, for example which can be secured along or about the firearm trigger to prevent access to the same.

Although useful in their inception, these devices suffer from several drawbacks. For example, because these locking mechanisms are externally mounted, it is not uncommon for one or more pieces of the lock to become lost when the same is not secured onto the weapon. Additionally, it is not uncommon for users to secure the lock onto the weapon incorrectly, thereby causing a situation where unauthorized access can occur. Finally, the time required to correctly secure and/or physically remove the external lock may be unacceptable in emergency situations where the user needs immediate access to the weapon.

For these reasons, many individuals rely solely on the integrated safety mechanism of the firearm to act as the only means for securing the weapon in an inoperable state. Although these systems work well to prevent accidental discharge of the firearm, they do nothing to prevent unauthorized users from operating the firearm.

Accordingly, it would be beneficial to provide a long gun stock with a sliding trigger enclosure that can replace the factory stock of the firearm and can function to secure the firearm in a locked state, so as to overcome the drawbacks described above.

SUMMARY OF THE INVENTION

The present invention is directed to a sliding trigger enclosure system for a long gun. One embodiment of the present invention can include a frame that is secured to the receiver of a firearm by factory-supplied hardware, and a hollow shoulder stock having a pair of side surfaces that extend outward from the front end. The shoulder stock is slidingly engaged over the frame and is capable of transitioning between a FIRE position where the trigger assembly of the long gun is accessible, and a SAFE position where the pair of side surfaces are locked in a parallel orientation to the trigger assembly to prevent access to the same.

Another embodiment of the present invention can include a locking mechanism that is disposed along the frame and can function to secure the shoulder stock in the SAFE position. The locking mechanism can include a pair of spring-loaded locking pins that are engaged by an actuator.

Yet another embodiment of the present invention can include a user authentication device such as a combination lock or a biometric sensor for authenticating a user's identity before allowing the stock to be transitioned from the SAFE position to the FIRE position.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
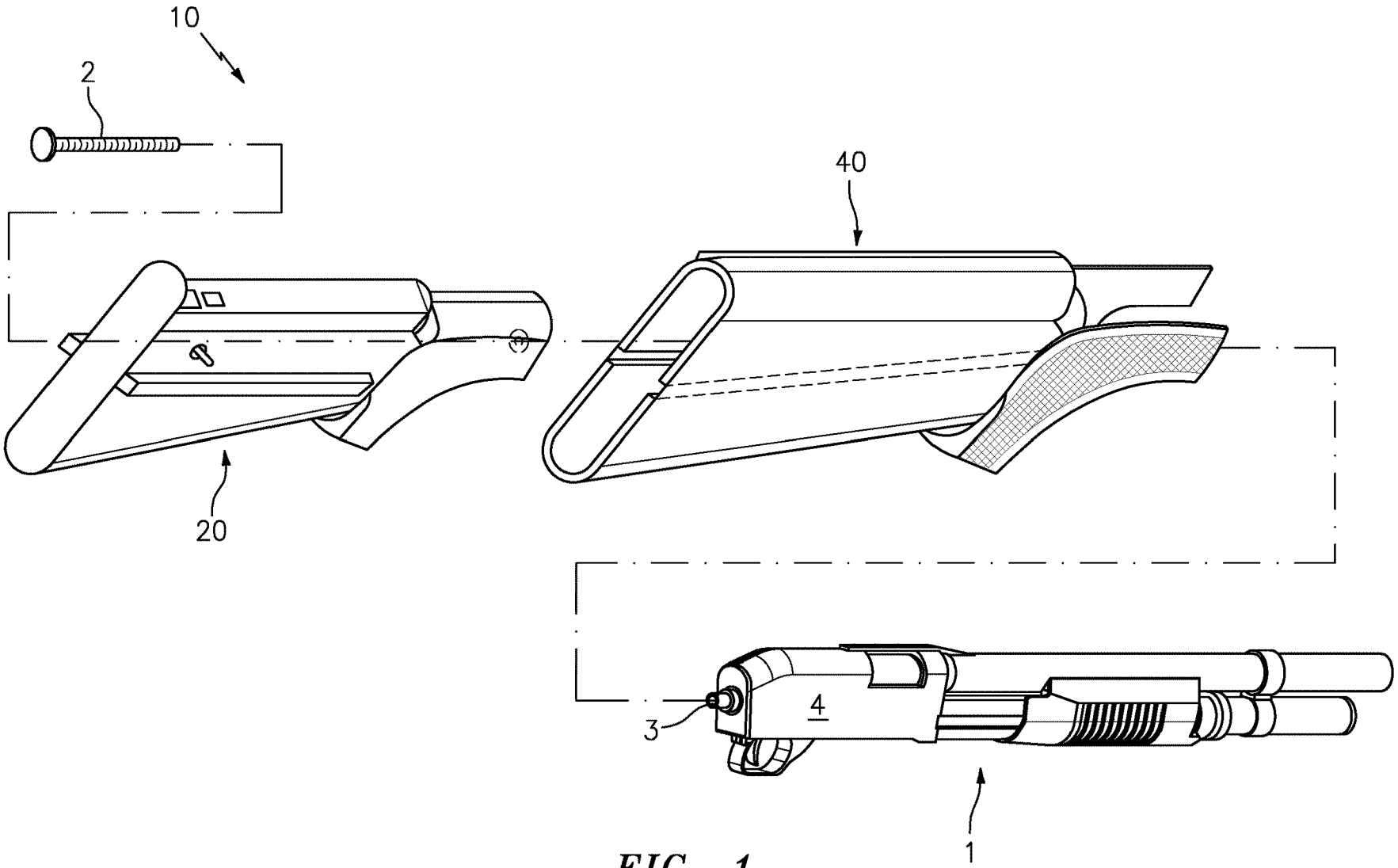
FIG. 1 is an exploded parts view of a long gun stock with a sliding trigger enclosure system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

A firearm, for the purposes of this description, relates to a mechanical device capable of discharging a bullet or other projectile in a given direction. A long gun is defined as a firearm having an extended barrel length and a butt stock that is typically designed to be rested against a user's shoulder while being aimed and fired. Several examples of a long gun include shotguns and rifles, for example. A firearm has a longitudinal axis extending from the butt stock to the tip of the weapon's barrel, and the firearm is defined as being upright when held in a position such that a trigger area is beneath the barrel of the firearm.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnets, and/or compression fittings such as locking pins, clamps, nut/bolts, tethers (e.g., zip ties), snaps and buttons, for example.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

As described throughout this document, the term "complementary shape," and "complementary dimension," shall be used to describe a shape and size of a component that is identical to, or substantially identical to the shape and size of another identified component.

Although illustrated throughout this document with reference to a shotgun, this is but one possible implementation of the inventive concepts, which can be equally utilized with any other type of long gun, regardless of make, model or manufacturer.

FIGS. 1-6 illustrate one embodiment of a long gun stock with a sliding trigger enclosure system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 is an exploded parts view of the system components. As shown, the system 10 can include, essentially, an internal frame member 20 and a sliding shoulder stock 40. In an aftermarket configuration, the system 10 is designed to replace the factory butt stock of a firearm 1 utilizing the factory-supplied bolt 2 for engaging the threaded aperture 3 of the firearm receiver 4. Alternatively, the system 10 can be incorporated into the design and manufacture of a new firearm so as to be an OEM component.

Figure 2A:
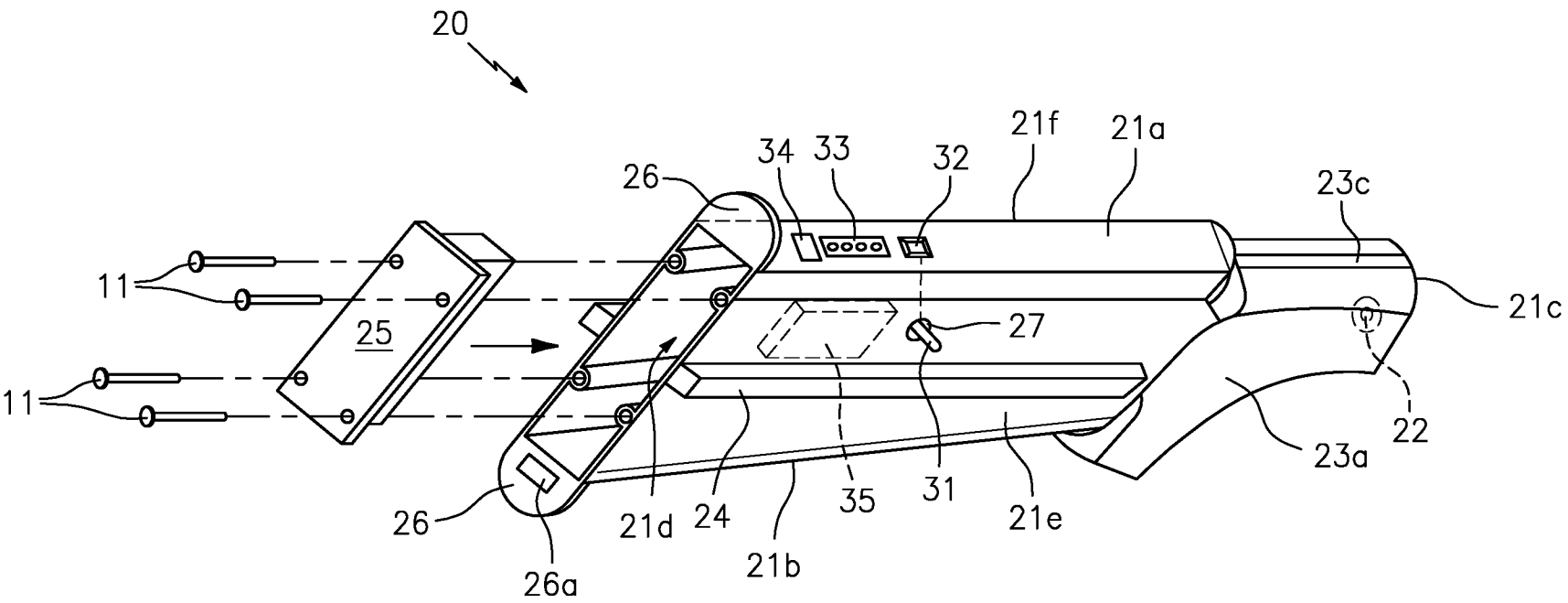
FIG. 2A is a perspective view of the frame of the long gun stock with a sliding trigger enclosure system, in accordance with one embodiment of the invention.
Figure 2B:
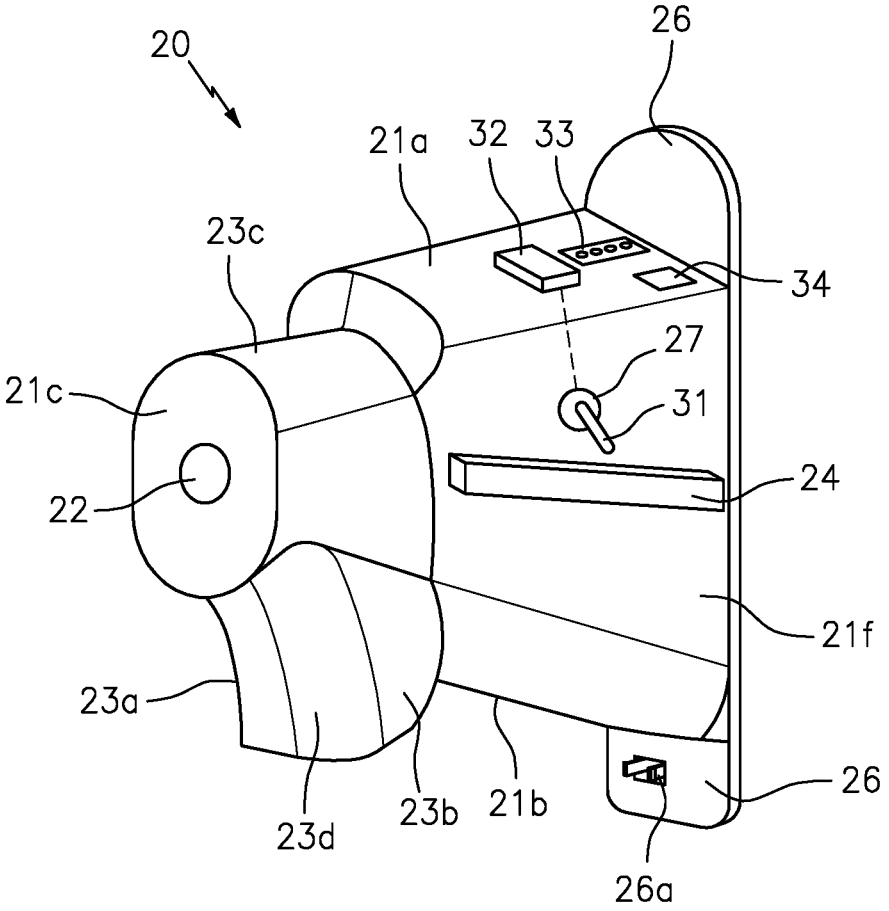
FIG. 2B is a front view of the frame of the long gun stock with a sliding trigger enclosure system, in accordance with one embodiment of the invention.

As shown in FIGS. 2A and 2B, one embodiment of the internal frame member 20 can include an elongated main body having a top surface 21*a*, a bottom surface 21*b*, a front end 21*c*, an open back end 21*d* and a pair of opposing side surfaces 21*e* and 21*f*, that define a generally hollow interior space.

As will be described below, the frame member 20 is designed to be positioned within the sliding shoulder stock 40, and therefore will include a shape and size that is suitable for this purpose. In various embodiments, the entirety or a portion of the outside facing surface of the frame member 20 can include a shape and size that is complementary to the entirety or a portion of the inside facing surface of the shoulder stock 40.

In either instance, a mounting aperture 22 is disposed along the front end 21*c* for receiving the factory bolt that secures the system to a firearm receiver. In this regard, the aperture 22 can include a shape, size, location and orientation that is complementary to the shape, size, location and/or orientation of the mounting aperture on the factory supplied butt stock of the weapon to which the system 10 is designed to replace, so as to allow the device 10 to be installed onto the firearm using the factory supplied hardware.

In the illustrated embodiment, the frame member 20 can include a forward handle section that is defined by a pair of curved side surfaces 23*a* and 23*b*, an upper surface 23*c*, and a bottom surface 23*d*. As will be described below the upper and bottom handle surfaces can be exposed when the system is in the unlocked orientation, as such these sections may include additional features such as texturing, for example, to facilitate better grip by a device user.

As shown, a pair of elongated protruding channels 24 can extend along the side surfaces 21*e* and 21*f*. The channels can be arranged along the longitudinal axis of the firearm, or can be offset from the longitudinal axis so as to allow the sliding stock to move in a different axis (e.g., slightly upward or downward), so as to ensure the side portions of the sliding shoulder stock completely cover the firearm trigger assembly.

In one embodiment, a removable recoil pad 25 can be secured within the open back end 21*d* of the frame body via connectors 11. In the preferred embodiment, the connectors can comprise security bolts having heads that can be engaged only by a specialty tool or wrench that can be provided with the system. Of course, any number of other devices capable of securing the recoil pad onto the frame in a removable manner while preventing access to the interior space of the frame body are also contemplated. Such features being designed to prevent or reduce the likelihood of an unauthorized person removing the system 10 from the firearm in order to fire the weapon.

In one embodiment, a pair of retaining tabs 26 can extend outward from the top and bottom surfaces of the main body 21*a* and 21*b*, respectively. The retaining tabs including a height (e.g., distance from the main body) that is greater than, or complementary to the thickness of the sliding shoulder stock 40 described below, so as to prevent the back end of the stock from traveling beyond the back end of the frame 20, and for securing the stock in the firing position. To this end, one or more push clips 26*a* or other type of connector/retention elements can also be disposed along one or both of the tabs. The retention element(s) functioning to selectively engage the distal end of the shoulder stock to temporarily secure the stock in the open/FIRE position until the retention element is engaged by the user, whereby the stock will slide to the naturally closed/SAFE position.

A system locking mechanism can be disposed within the interior space of the main body 20 and can function to selectively allow and prevent movement of the below described sliding stock 40. In one embodiment the locking mechanism can include a pair of locking pins 31 that are connected to an actuator 32 and/or an authentication device 33.

In the preferred embodiment, the locking pins 31 can include, comprise or consist of spring-loaded metallic pins that are connected to the actuator so as to transition between an extended and retracted position. When in the extended position, the pins can extend through openings 27 along the sides of the main body 21*e* and 21*f*, thereby blocking the passage of the back end of the shoulder stock and preventing the stock from sliding from the SAFE position to the FIRE position. Conversely, when the pins are in the retracted position, the pins will not interfere with the operation of the sliding stock. The pins can be constructed so as to automatically deploy/transition to the extended position when the actuator is not engaged, thus ensuring the device defaults to the SAFE position at all times.

Although described as including two metal pins located along the sides of the frame member, this is for illustrative purposes only. To this end, any number of other devices capable of being selectively activated to alternately block and allow movement of the sliding stock are also contemplated, regardless of shape, size or materials.

In the preferred embodiment, the actuator 32 can include a push button that is disposed along the top end of the main body 21*f*. The button being connected to the locking pins via an internal rod whereby receipt of a pressing force on the button results in commensurate movement of the rod, thus overcoming the tension of the springs on the pins and causing the pins retract. Conversely, when no force is applied onto the actuator the springs of the pins automatically transitions/maintains the pins to the extended state.

Although described with regard to a button and rod arrangement, this is for illustrative purposes only. As such, any number of other devices and components capable of extending and retracting the pins are also contemplated.

The authentication device 33 can include any number of devices capable of accepting a user input so as to allow operation of the actuator. In one embodiment, the device can include a mechanical combination lock having a series of numbers or letters which must be entered in a proper sequence to allow the actuator to move. In this regard, the authentication device can be physically coupled to the actuator, the actuator rod and/or the locking pins directly, and can function to disable movement of the actuator unless the proper sequence has been entered. Combination locking systems and associated components are extremely well known in the art, and any number of such commercially available systems can be utilized herein.

Although described above as including purely mechanical locking, actuation and authentication components, various embodiments of the system 10 also contemplate use of electromechanical components, wherein the locking pins 31 are controlled by, or comprise one or more linear actuators that are in communication with an electronic authentication unit 34 and an internal control assembly 35.

Figure 3:
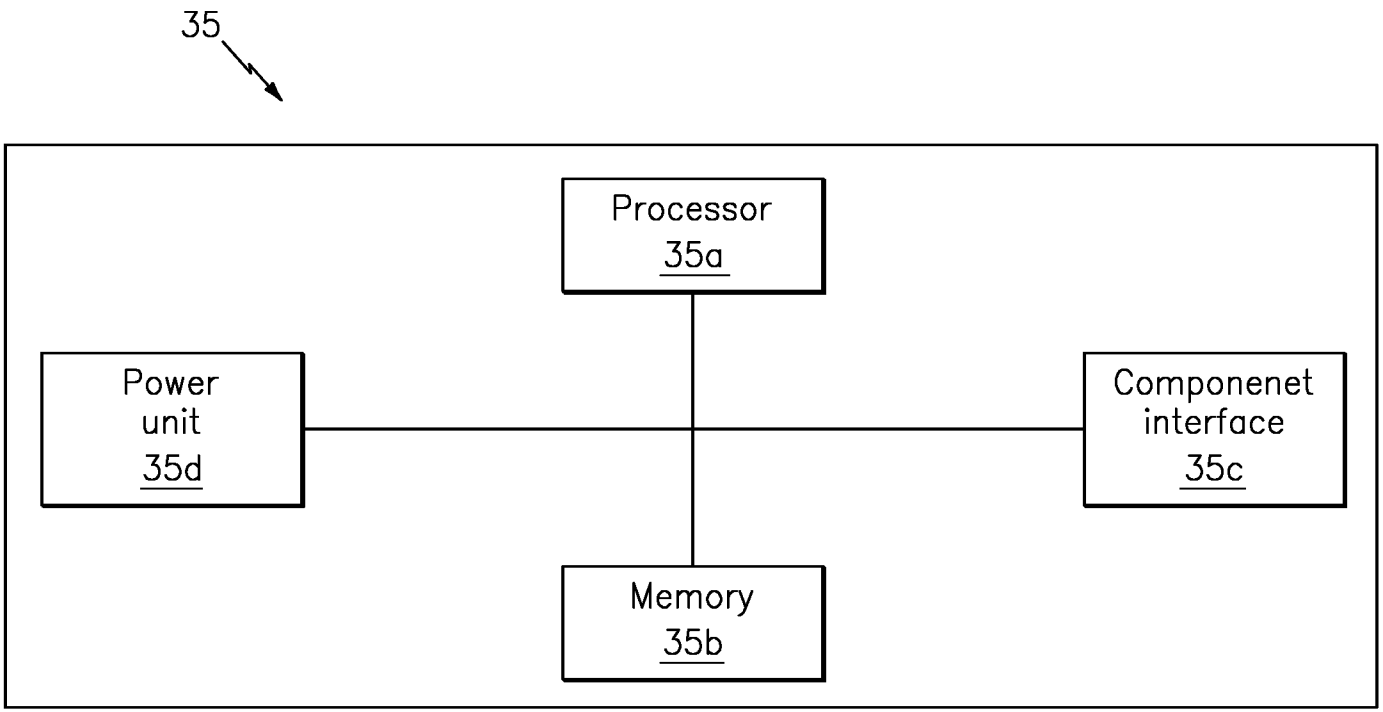
FIG. 3 is a block diagram of a control assembly of the long gun stock with a sliding trigger enclosure system, in accordance with one embodiment of the invention.

FIG. 3 illustrates one embodiment of the internal control assembly 35 which can function to control an operation of the locking pins, the authentication unit and actuator. In one embodiment, the internal control assembly can include a processor 35*a* that is conventionally connected to an internal memory 35*b*, a component interface unit 35*c*, and/or a power source 35*c*.

Although illustrated as separate elements, those of skill in the art will recognize that one or more assembly components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The processor/CPU 35*a* can act to execute program code stored in the memory 35*b* in order to allow the device to perform the functionality described herein. Memory 35*b* can act to store operating instructions in the form of program code for the processor 35*a* to execute.

The component interface unit 35*c* can function to provide a communicative link between the processor 35*a* and various other device components such as the linear actuator(s), the authentication unit and/or the actuator. In this regard, the component interface unit can include any number of different components such as one or more PIC microcontrollers, internal bus, USB connections and other such hardware capable of providing a direct link between the various components. Of course, any other means for providing the two way communication between the device components can also be utilized herein.

As described herein, the electronic authentication unit 34 can include any number of different components that are capable of accepting a user input so as to transition the locking pins 31 into the retracted position, in order to allow a user access to the firearm trigger assembly. In the preferred embodiment, the electronic authentication unit can include or control a biometric authentication unit such as the illustrated fingerprint sensor 34, for example that can be located anywhere along the frame 20.

As will be known to those of skill in the art, a biometric authentication unit may record the fingerprint of the user and store the image of the fingerprint in the memory 35*b*. As such, upon recognition of the user's fingerprint applied to the sensor, the processor can instruct the locking pins to retract, thereby allowing the sliding shoulder stock to transition from the SAFE position to the FIRE position. Of course, the authentication unit is not limited to the use of a biometric sensor, as any number of other known systems for receiving and/or verifying a user input are also contemplated. Several nonlimiting examples include the use of an electromechanical combination lock system and/or a wireless authentication system such as an RFID interrogator that can be used with an externally located RFID sensor, for example.

In the preferred embodiment, the power source 35*c* can include one or more DC batteries capable of providing the necessary power requirements to each element of the device 10. In one embodiment, the batteries can be permanently located within the main body 20 and can be rechargeable in nature via a charging port such as a mini or micro USB port, for example. Of course, traditional batteries can also be utilized, and the main body can further include a battery compartment having a removable cover (not illustrated) for allowing a user to access the same.

Figure 4A:
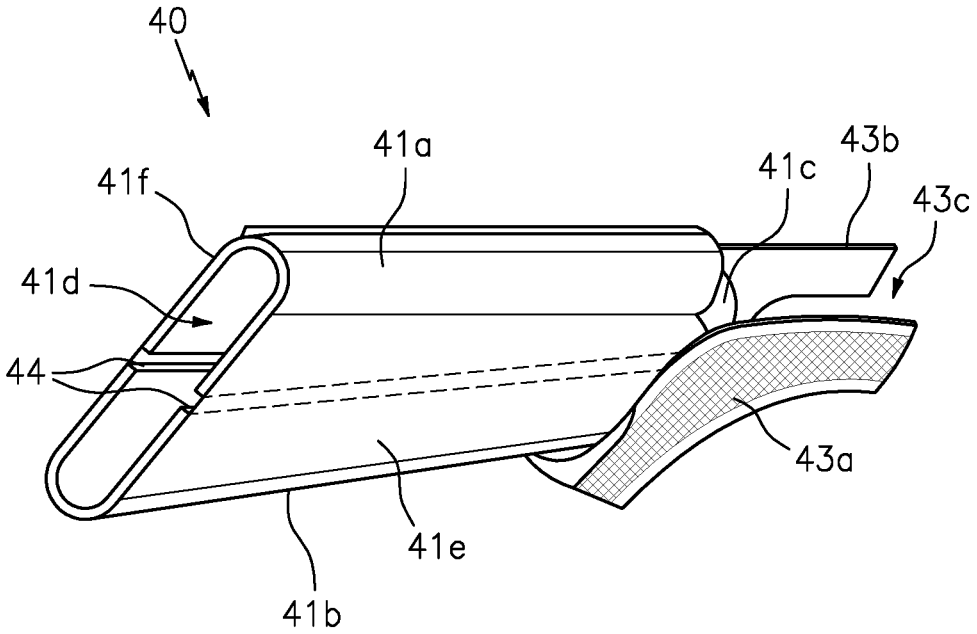
FIG. 4A is a perspective view of the shoulder stock of the long gun stock with a sliding trigger enclosure system, in accordance with one embodiment of the invention.
Figure 4B:
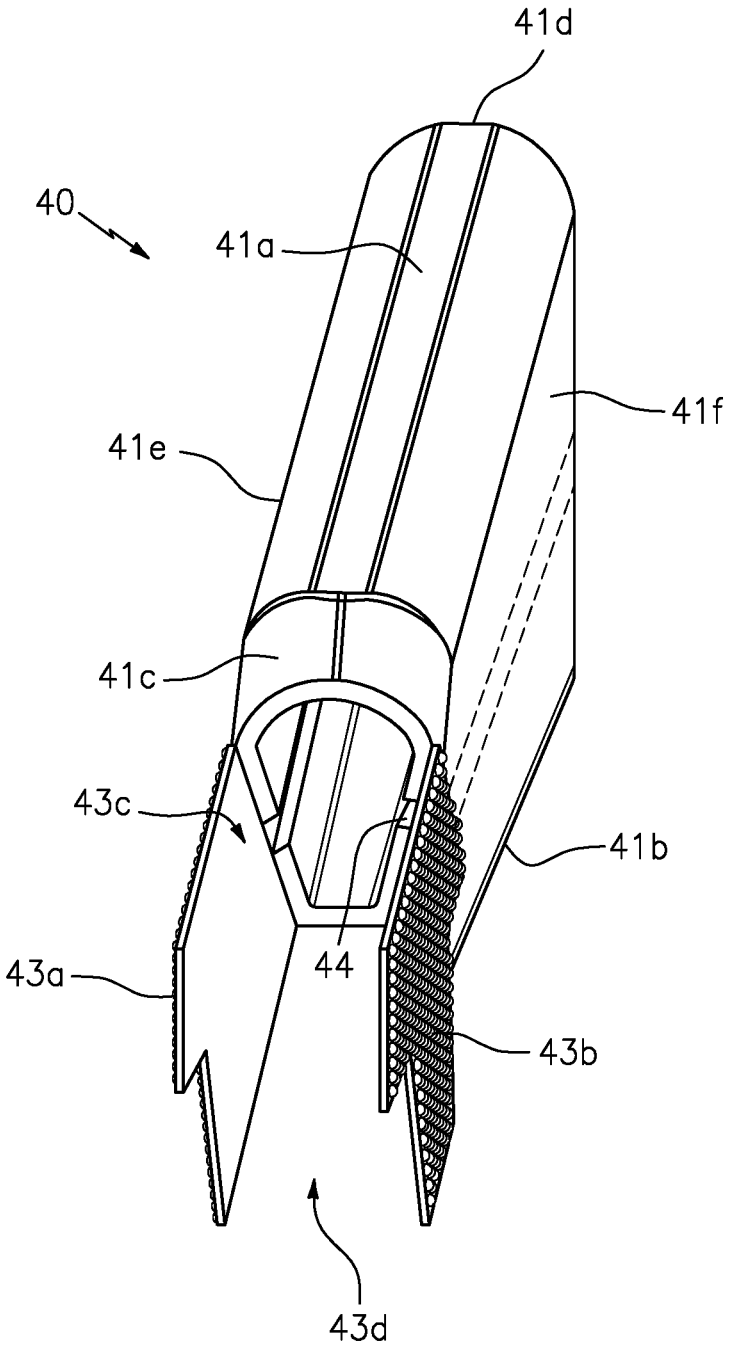
FIG. 4B is a front view of the shoulder stock of the long gun stock with a sliding trigger enclosure system, in accordance with one embodiment of the invention.
Figure 5:
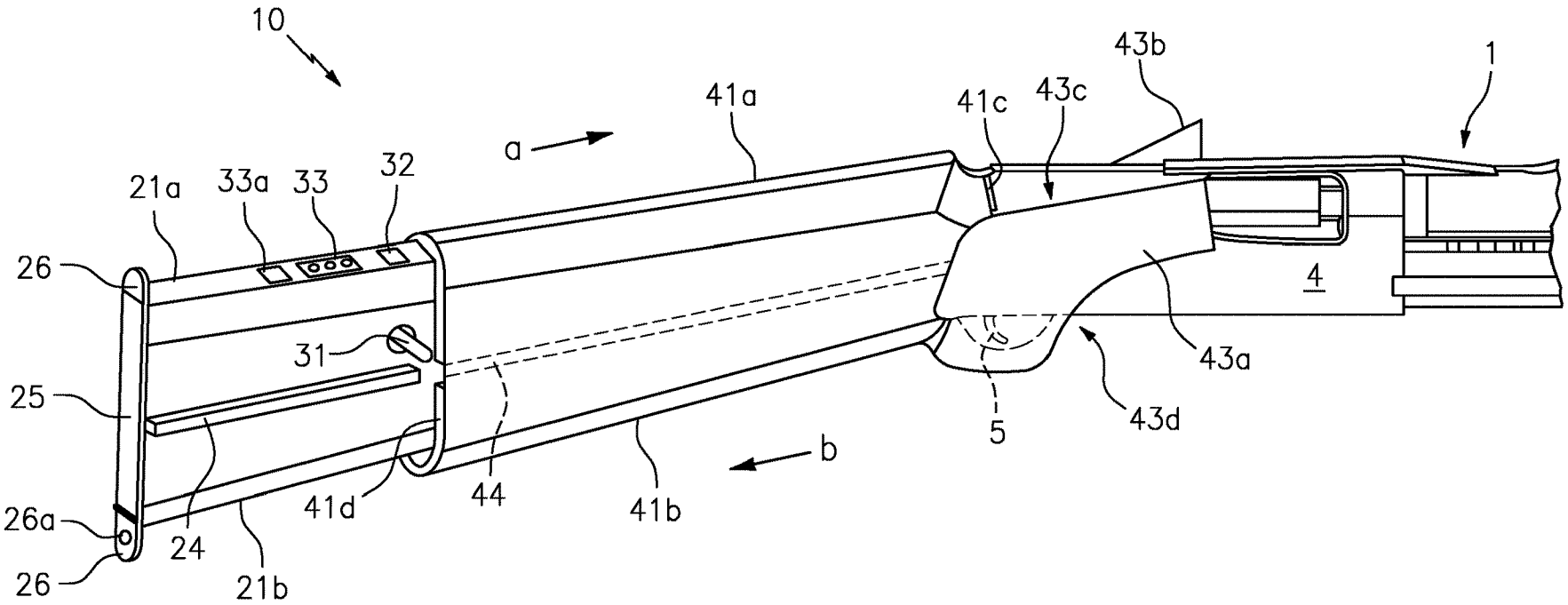
FIG. 5 is a side view of the long gun stock with a sliding trigger enclosure system in operation, in accordance with one embodiment of the invention.

FIGS. 4 and 5 illustrate one embodiment of the sliding shoulder stock 40. As shown, the stock can include an elongated main body having a top surface 41*a*, a bottom surface 41*b*, an open front end 41*c*, an open back end 41*d* and a pair of opposing side surfaces 41*e* and 41*f*, that define a hollow interior space. The interior space of the shoulder stock 40 includes a shape and size that is complementary to the exterior shape of the frame member 20 so as to allow the frame member to be slidingly positioned within the shoulder stock.

The shoulder stock can also include a forward handle section that is defined by a pair of curved side surfaces 43*a* and 43*b* that extend outward from the front end 41*c*. The side surfaces defining openings 43*c* and 43*d* along the top and bottom ends of the forward handle section that have complementary shapes to the frame handle sections 23*c* and 23*d*, respectively.

As shown, a pair of elongated grooves 44 can be positioned along the inside facing portions of the side walls 41*e* and 41*f*. The grooves can function to receive the above described channels 24 so as to allow the shoulder stock 40 to slide along the frame member 20 (e.g., slidingly engage).

Figure 6:
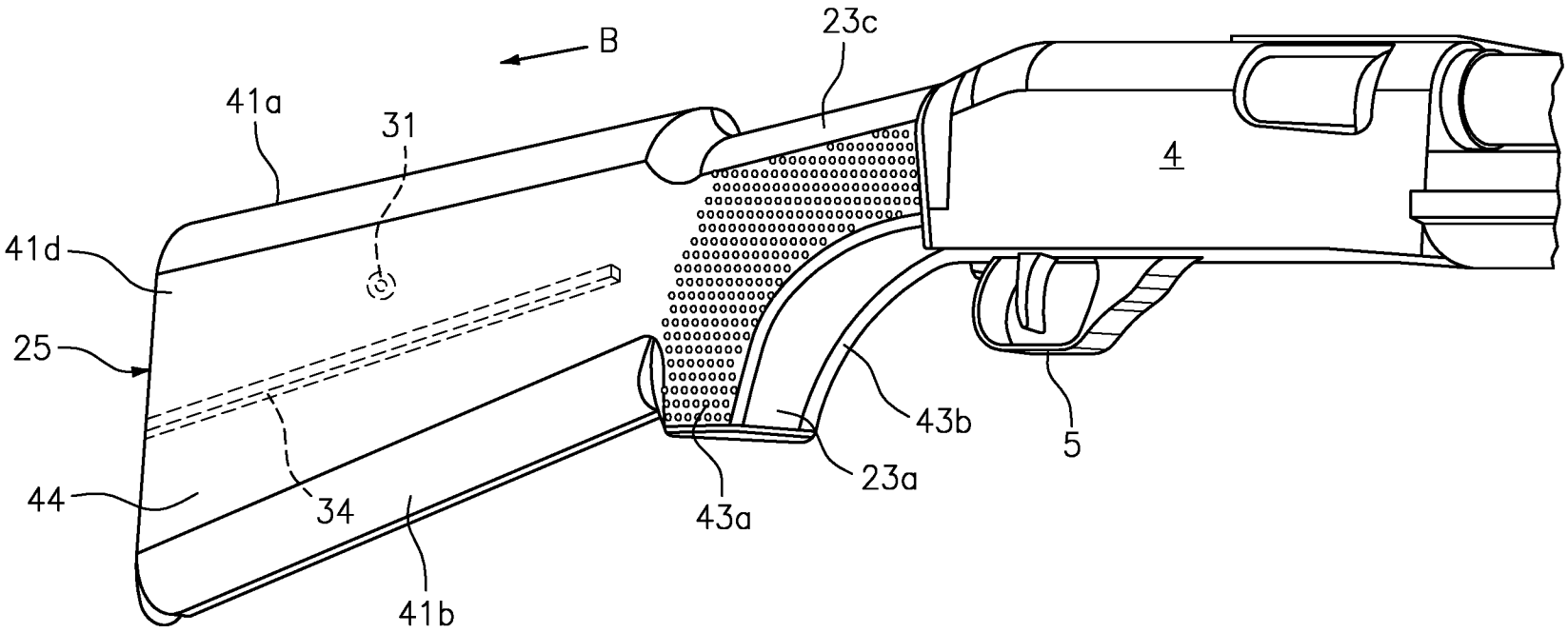
FIG. 6 is another side view of the long gun stock with a sliding trigger enclosure system in operation, in accordance with one embodiment of the invention.

FIGS. 5 and 6 illustrate one embodiment of the system 10 in operation on a firearm 1, whereby the grooves 44 and channels 24 are aligned to allow the shoulder stock 40 to be slid along the frame 20 so as to selectively block and allow access to the firearm trigger assembly 5.

As shown in FIG. 5, when the device 10 is in the locked/SAFE position the stock 40 can be slid forward (arrow a) until the trigger assembly 5 is located within the bottom opening 43*d* of the stock and the sides 43*a* and 43*b* are positioned along both sides of the trigger assembly. When in this position, the frame of the trigger assembly prevents access to the firearm trigger from the bottom, and the sides 43*a* and 43*b* prevent access to the trigger from the sides. Additionally, when in this position the front end of the stock 41*c* can be in contact with the back of the receiver 5, so as to prevent additional forward movement of the stock, and a portion of the top end of the receiver can be located within the top opening 43*c*.

When so positioned, the back end 41*d* of the stock will be located forward of the locking pins 31, which will preferably automatically extend thus preventing the stock from sliding backward (arrow b) toward the tabs 26. At this time, the sliding stock will remain immobile in the locked/SAFE position until the pins 31 are retracted through operation of the actuator 32 and/or locking mechanism(s) 33 and/or 33*a*.

FIG. 6 illustrates one embodiment of the system 10 in the unlocked/FIRE position. To this end, once the locking pins have been retracted, the stock 40 can slide backwards until the back end 41*d* of the stock is in communication with the tabs 26. At this time, the handle sections of the frame 23*a* and 23*b* will be parallel with the handle sections of the stock 43*a* and 43*b*, respectively, and the upper and bottom surfaces 23*c* and 23*d* of the frame will be positioned within the openings 43*c* and 43*d*, respectively.

When so positioned, the frame and stock function together to result in the visual appearance of an ordinary shoulder stock wherein the trigger assembly 5 of the firearm is accessible.

As described herein, one or more elements of the long gun stock with a sliding trigger enclosure system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A sliding trigger enclosure system for a long gun, said system comprising:

a frame having a plurality of sides, a back end, and a front end that is configured to be secured to a receiver of a long gun, the receiver having a trigger assembly; and a hollow shoulder stock that is slidingly engaged to the frame, said shoulder stock having a back end, a front end, and a pair of side surfaces that extend outward from the front end, wherein the shoulder stock is configured to be selectively positioned at both a FIRE position where the trigger assembly on the receiver of the long gun is accessible, and a SAFE position where the pair of side surfaces are in a parallel orientation to the trigger assembly on the receiver of the long gun to prevent access to the trigger assembly.

2. The system of claim 1, further comprising:

a mounting aperture that is positioned along the front end of the frame at a location that is complementary to a location of a threaded aperture located on the receiver of the long gun, and said mounting aperture including a shape that is suitable for receiving a factory bolt for securing the frame to the receiver.

3. The system of claim 1, further comprising:

a locking mechanism that is configured to secure the shoulder stock in the SAFE position.

4. The system of claim 3, wherein the locking mechanism includes at least one locking pin that is configured to transition between an extended position and a retracted position; and an actuator that functions to transition each of the at least one locking pin between the extended position and the retracted position, wherein in the extended position each of the at least one locking pins are configured to engage the back end of the shoulder stock to lock the shoulder stock in the SAFE position, and in the retracted position the shoulder stock is in the FIRE position.

5. The system of claim 4, wherein each of the at least one locking pins comprise a spring-loaded locking pin that defaults to the extended position.

6. The system of claim 5, wherein the actuator is configured to transition each of the at least one locking pins from the extended position to the retracted position.

7. The system of claim 4, further comprising:

a user interface that is configured to receive a user instruction to allow operation of the actuator.

8. The system of claim 7, wherein the user interface includes a mechanical combination lock.

9. The system of claim 7, wherein the user interface includes an electromechanical component.

10. The system of claim 1, further comprising:

a recoil pad that is removably secured to the back end of the frame.

11. The system of claim 10 wherein the recoil pad is secured to the frame via one or more security bolts.

12. The system of claim 1, further comprising:

a pair of retaining tabs that are located along the back end of the frame, said retaining tabs being configured to engage the back end of the sliding stock in the FIRE position.

13. A firearm having a sliding trigger enclosure system, said firearm comprising:

a receiver having a back end and a bottom end;

a trigger assembly that is positioned along the bottom end of the receiver;

a frame having a plurality of sides, a back end, and a front end that is secured to the back end of the receiver; and a hollow shoulder stock that is slidingly engaged to the frame, said shoulder stock having a back end, a front end, and a pair of side surfaces that extend outward from the front end, wherein the shoulder stock is configured to be selectively positioned at both a FIRE position where a trigger assembly of the long gun is accessible, and a SAFE position where the pair of side surfaces are in a parallel orientation to the trigger assembly of the long gun to prevent access to the trigger assembly.

14. The system of claim 13, further comprising:

a locking mechanism that is configured to secure the shoulder stock in the SAFE position.

15. The system of claim 14, wherein the locking mechanism comprises:

at least one locking pin that is configured to transition between an extended position and a retracted position; and an actuator that functions to transition each of the at least one locking pin between the extended position and the retracted position, wherein in the extended position each of the at least one locking pins are configured to engage the back end of the shoulder stock to lock the shoulder stock in the SAFE position, and in the retracted position the shoulder stock is in the FIRE position.

16. The system of claim 15, wherein each of the at least one locking pins comprise a spring-loaded locking pin that defaults to the extended position.

17. The system of claim 15, further comprising:

a user interface that is configured to receive a user instruction to allow operation of the actuator, said user interface including at least one of a mechanical combination lock or a biometric sensor.

18. The system of claim 13, further comprising:

a recoil pad that is removably secured to the back end of the frame.

19. The system of claim 18 wherein the recoil pad is secured to the frame via one or more security bolts.

20. The system of claim 13, further comprising:

a pair of retaining tabs that are located along the back end of the frame, said retaining tabs being configured to engage the back end of the sliding stock in the FIRE position.

* * * * *